US005329797A

United States Patent [19]

Calhoun

[11] Patent Number: 5,329,797

[45] Date of Patent: Jul. 19, 1994

[54] TUBE-RESIZING TOOL

[76] Inventor: John Calhoun, 1948 Perry Ave., Groves, Tex. 77619

[21] Appl. No.: 63,881

[22] Filed: May 18, 1993

[51] Int. Cl.[5] ..... B21D 17/04

[52] U.S. Cl. ..... 72/121; 72/126

[58] Field of Search ..... 72/67, 74, 121, 124, 72/126, 211

[56] References Cited

U.S. PATENT DOCUMENTS

| | | | |
|---|---|---|---|
| 524,400 | 8/1894 | Rinman | 72/211 |
| 909,182 | 1/1909 | Hart | 72/124 |
| 1,484,023 | 2/1924 | Hayter . | |
| 1,674,440 | 6/1928 | McCloskey . | |
| 2,948,170 | 8/1960 | Kemp | 81/15 |
| 3,013,335 | 12/1961 | Kowal | 30/94 |
| 3,041,723 | 7/1962 | Franck | 30/102 |
| 3,071,993 | 1/1963 | Foster, Sr. et al. | 81/15 |
| 3,082,523 | 3/1963 | Modes et al. | 30/102 |
| 3,146,820 | 9/1964 | Mailloux | 72/67 |
| 3,196,652 | 7/1965 | Meese | 72/70 |
| 3,376,638 | 4/1968 | Bjalme et al. | 30/102 |
| 3,408,738 | 11/1968 | Schade | 30/95 |
| 3,545,081 | 12/1970 | Butler | 30/123 |
| 3,639,980 | 2/1972 | Muse et al. | 30/102 |
| 3,651,569 | 3/1972 | Arnot | 30/95 |
| 3,885,261 | 5/1975 | Skvarenia | 30/102 |
| 3,932,937 | 1/1976 | Bastiansen | 30/102 |
| 3,965,572 | 6/1976 | Strybel | 30/102 |
| 4,389,867 | 6/1983 | Whitlock | 72/126 |
| 4,655,064 | 4/1987 | Hoback | 72/35 |
| 4,769,910 | 9/1988 | Noon | 30/91.2 |
| 4,769,911 | 9/1988 | Araki | 30/94 |

*Primary Examiner*—Lowell A. Larson

*Attorney, Agent, or Firm*—Pravel, Hewitt, Kimball & Krieger

[57] ABSTRACT

A tube-resizing tool comprising: a frame assembly including a first leg and a second leg, the first leg and the second leg positioned in such a way as to straddle and secure the section of tubing to be resized, and the first and second legs being adjustable toward or away from one another so as to accommodate and secure tubing of different diameters; two rollers rotatably mounted to the first leg; and a resizing wheel rotatably mounted to the second leg, the resizing wheel having a substantially uniform outer peripheral cross-section, and the resizing wheel having a length less than the length of each of the rollers.

6 Claims, 1 Drawing Sheet

FIG.1
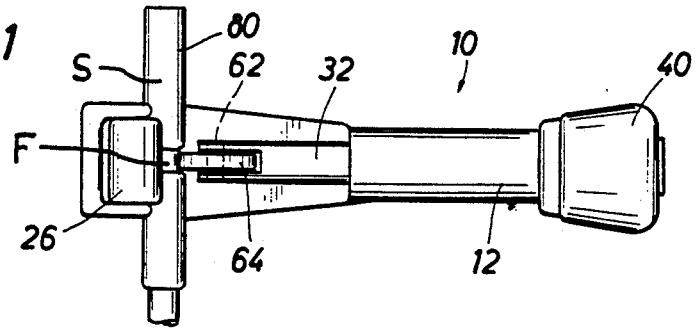
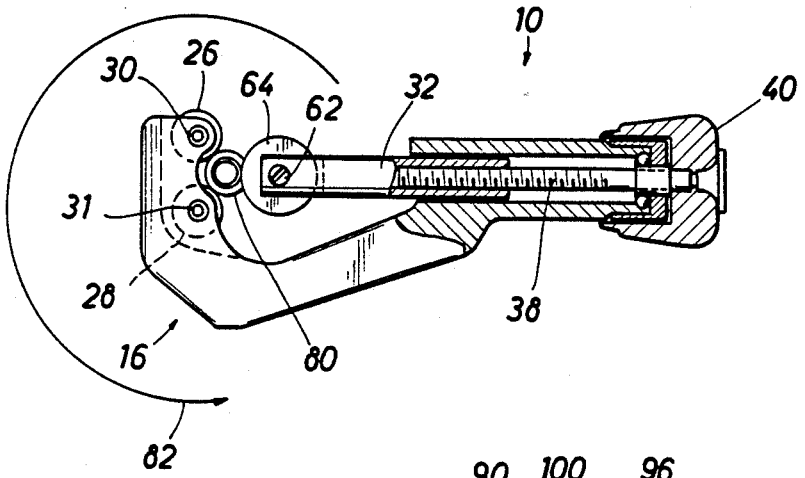
FIG.2
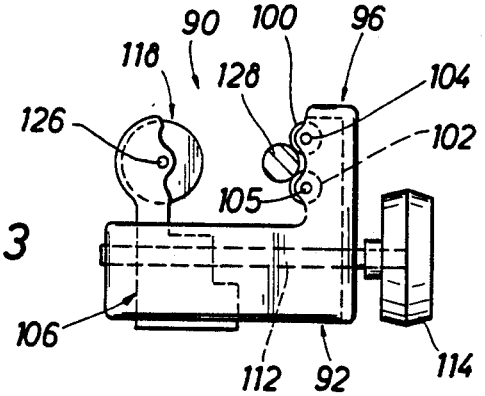
FIG.3
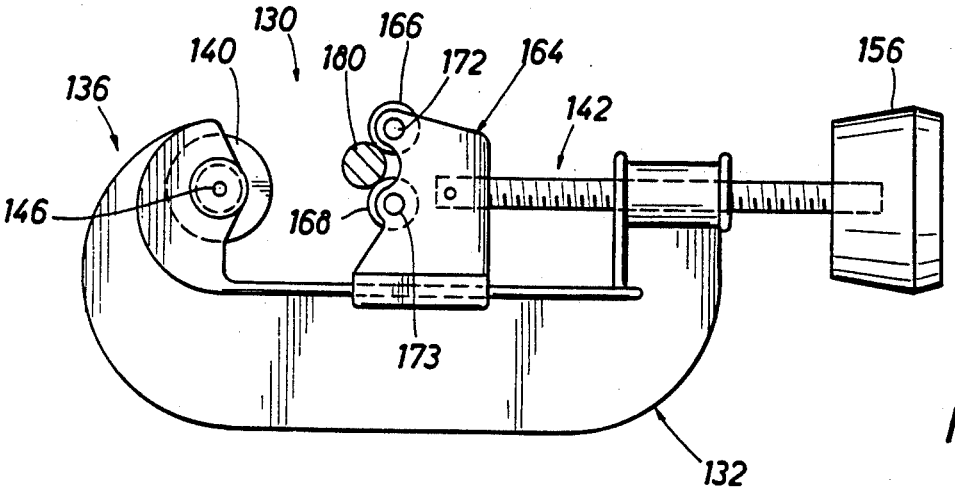
FIG.4

TUBE-RESIZING TOOL

BACKGROUND OF THE INVENTION

A. Field of the Invention

This invention relates to a tube working tool and, more particularly, to a tool for resizing/reducing the tube diameter in soft, metal tubing (e.g., copper or brass tubing).

B. Description of Related Art

Bursted pipes have traditionally created very frustrating conditions for plumbers and other technicians who work with broken pipes. In most cases when pipes burst, they normally expand for a distance on either side of the actual rupture. The cracked or bursted section is usually cut out and a new section is inserted. However, because the pipe has expanded, it is virtually impossible to effect a repair of the pipe with a pipe of the same diameter.

The only effective way to repair the section is by using a pipe of a larger size or an adapter. This method can be difficult as well as very costly because pipes will not normally expand to a pipe size that is readily available. The other alternative in effecting a repair is to replace the entire pipe. This option can also be very costly because in most instances, such a replacement entails more than just a small piece of pipe. Because of the various problems associated with the present methods of fixing bursted pipes, it is desirable to provide a single convenient tool that will allow a technician to resize the expanded section of a bursted pipe.

A number of attempts have been made to provide tube-working tools to solve various problems associated with pipes and other cylindrical articles. Most of these tools have been directed to tube-cutting, rather than tube-resizing. A listing of these tools would include:

Hayter (U.S. Pat. No. 1,484,023) discloses a pipe cutter; McCloskey (U.S. Pat. No. 1,674,440) discloses a pipe cutter and burr remover; Kemp (U.S. Pat. No. 2,948,170) describes an apparatus for making a joint between a metal tube and an object engageable therein); Kowal (U.S. Pat. No. 3,013,335) discloses another tube cutter.

Foster, et al. (U.S. Pat. No. 3,071,993) discloses an apparatus for making tube joints wherein the wheel making the joint has a rounded or "semi-circular" face (see FIG. 8 generally and FIG. 9 reference numeral 36 specifically). This semi-circular wheel design apparently makes a tube joint by simultaneously crimping/interlocking two concentric tube sections. The semi-circular wheel design, however, is not capable of producing a resized tube which is the object of this invention.

Modes, et al. (U.S. Pat. No. 3,082,523) describes a stripping tool; Neese (U.S. Pat. No. 3,196,652) teaches swaging back-up rollers; Bjalme, et al. (U.S. Pat. No. 3,376,638) discloses a pipe cutter having half nut guided for movement toward and away from the pressure screw; Butler (U.S. Pat. No. 3,545,081) discloses another type of tubing cutter; and Muse, et al. (U.S. Pat. No. 3,639,980) describes another pipe cutter.

Arnot (U.S. Pat. No. 3,651,569) describes a device for working a cylindrical work-piece; Skvarenina (U.S. Pat. No. 3,885,261) teaches a pipe cutting tool; Bastiansen (U.S. Pat. No. 3,932,937) discloses a tool for cutting and graduating plastic tubes; and Strybel (U.S. Pat. No. 3,965,572) teaches yet another tube cutter.

Whitlock (U.S. Pat. No. 4,389,867) discloses a specific tool for restoring roundness to metal tubing. Whitlock teaches the use of rollers of identical length, potentially varying only the diameters and/or the spacing of two pairs of rollers. Hoback (U.S. Pat. No. 4,655,064) describes a rotary gripping tool, and Noon (U.S. Pat. No. 4,769,910) discloses a cutting tool for cylindrical articles.

None of these references, however, teaches how to make a tool which would efficiently and easily resize the expanded section of a bursted tubing. In fact, a number of these references teach away from the invention disclosed or they suggest a design which is poorly suited to the task.

SUMMARY OF THE INVENTION

The invention can be quickly comprehended by a review of the following overview of the first embodiment of the invention, illustrated in FIGS. 1 and 2.

In the first embodiment, the tube-resizing tool comprises a frame assembly including a supporting leg and an adjusting leg. The supporting leg and the adjusting leg are positioned in such a way as to straddle and secure the section of tubing to be resized. The adjusting leg is usually screw-adjustable toward or away from the supporting leg and, as such, can accommodate and secure tubing of different diameters.

Two rollers are rotatably mounted side by side to either the supporting leg or the adjusting leg and a single resizing wheel is rotatably mounted to the opposing leg to effect the resizing operation.

The design of this tool is unique in two respects, each of which is discussed in more detail in the Description Of The Preferred Embodiment. First, all the wheels, including the resizing wheel, have a uniform outer peripheral cross-section, and the resizing wheel is positioned such that its axis of rotation is between the axis of rotation of the opposing two rollers. Second, the resizing wheel has an overall length less than the length of each of the opposing two rollers. These features distinguish the tool from other tube working devices which explicitly feature rounded or "semi-circular" wheels and/or tube working devices featuring cooperative rollers and wheels of substantially similar length.

BRIEF DESCRIPTION OF THE DRAWINGS

FIG. 1 is a plan view of a first embodiment of a tubing resizing tool in accordance with the principles of the invention;

FIG. 2 is a side elevation view illustrating the internal operating system of the first embodiment of the tubing resizing tool in accordance with the principles of the invention.

FIG. 3 is a side elevation view illustrating the internal operating system of a second embodiment of the tubing resizing tool in accordance with the principles of the invention.

FIG. 4 is a side elevation view illustrating the internal operating system of a third embodiment of the tubing resizing tool in accordance with the principles of the invention.

DESCRIPTION OF THE PREFERRED EMBODIMENT

Referring to the drawings, there is shown in FIGS. 1 and 2 a first embodiment of a tube-resizing tool 10. The tool comprises a frame assembly 12 including a supporting leg 16 and an adjusting leg 32. The supporting leg 16 and the adjusting leg 32 are positioned in such a way as to straddle and secure the section of tubing to be resized, and the adjusting leg is adjustable toward or away from the supporting leg and securable so as to accommodate and secure tubing of different diameters by means of a screw mechanism 38 which is controlled by turning handle 40. In this embodiment, the adjusting leg 32 is pushed toward the supporting leg 16 by turning handle 40.

In this embodiment, two rollers 26 and 28 are rotatably mounted to the supporting leg 16 by pins 30 and 31, respectively. A resizing wheel 64 is rotatably mounted to the adjusting leg 32 by a pin 62. The resizing wheel 64 has a substantially uniform outer peripheral cross-section, which is positioned between the two opposing rollers and has a length less than the length of each of the two rollers 26 and 28.

It is critical that the resizing wheel 64 have a substantially uniform outer peripheral cross-section. This feature provides a substantially flat rolling surface in contact with the tube that is essential to reduce a length of tubing. Furthermore, the tube-resizing tool 10 features a resizing wheel 64 having a length less than the length of each of the two rollers 26 and 28. This feature helps to reduce the potential for crimping the tubing during the resizing operation.

The tube-resizing tool 10 features two rollers in tandem, each of which has a substantially identical common length. Furthermore, the tube-resizing tool 10 features a resizing wheel having a length less than the length of the two tandem rollers. This configuration has been found to be essential because it virtually eliminates the potential for crimping the tube during resizing. Preferably, the resizing wheel is about half the length of the tandem rollers and is positioned in the center of the tandem rollers. It has been found that the additional length of the tandem rollers stabilizes the tube during the resizing operation.

As previously stated, the tube-resizing tool 10 features two rollers 26 and 28 in tandem. The axes of the two rollers 26 and 28 are substantially parallel, the axes defining a first plane. The axis of the resizing wheel 64 is substantially parallel to the axes of the rollers 26 and 28. The projection of the axis of the resizing wheel 64 upon the first plane is a line substantially between the axes of the two rollers 26 and 28. The midpoint of the length of the resizing wheel 64 and the midpoints of the lengths of the rollers 26 and 28 lie in a second plane perpendicular to the first plane. This configuration is most preferred because it minimizes the potential for crimping the tube during the resizing operation.

The tube-resizing tool 10 has a preferred length of the resizing wheel of between 3/16 inches and 5/16 inches because this length has been found to be especially well-suited to resizing soft metal tubing (e.g., copper or brass tubing). A length of ¼ inches is especially preferred. The preferred device also features a supporting tandem roller length of between ½ inches and one inch, with 11/16 inches being especially preferred.

When the tube-resizing tool 10 is to be used to resize tubing 80, the user selects a tube section to be resized, defined by two points, a starting point "S" and a finishing point "F".

The tubing 80 is placed between the rollers 26 and 28 and the resizing wheel 64. The resizing wheel 64 is advanced so as to engage the tubing 80 at starting point S. The resizing wheel 64 is advanced sufficiently to press the surface of the tubing 80 a predetermined small amount, and it is secured at that position.

The tube-resizing tool 10 is then grasped by the frame assembly 12 and rotated about the tubing 80 as indicated by the arrow 82 (see FIG. 2) until the entire circumference of the tubing 80 at that location is the desired size. The resizing wheel 64 is retracted to allow the user to reposition the tube-resizing tool 10 down the axis of the tubing 80 toward point F. The resizing wheel should slightly overlap the previously resized portion of the tube to ensure a uniform resized section without ridges. This operation is repeated until the entire tube section, spanning points S to F, has been treated, completing a first cycle.

If the tube section from points S to F has the desired new cross-section, the resizing operation is now complete. If not, the first cycle may be repeated, yielding successive cycles, until the desired tube section cross-section is obtained. Of course, it is also possible to resize the tubing to a diameter less than the original diameter to eliminate the need for an adapter when joining pipes of differing diameters. It is also possible to resize a tube so as to fit inside another tube to eliminate the need for a pipe connector altogether.

In the common case in which the user simply desires a predetermined smaller tube diameter at point F, which happens to be the end of the tubing, the user will repeat the first cycle just disclosed, starting at a point S so that the tubing diameter is continually reduced from its original diameter at point S to a final reduced diameter at point F. The user performs successive cycles, beginning each cycle at a point that slightly overlaps the preceding cycle. These successive cycles are performed until the tube diameter at point F is reduced to the desired value.

Referring again to the drawings, there is shown in FIG. 3 a second embodiment of a tube-resizing tool 90 (also referred to as a tubing resizing tool). The tool comprises a frame assembly 92 including a supporting leg 96 and an adjusting leg 106, the supporting leg 96 and the adjusting leg 106 are positioned in such a way as to straddle and secure the section of tubing 128 to be resized, and the adjusting leg 106 is adjustable toward or away from the supporting leg 96 and securable so as to accommodate and secure tubing of different diameters.

Two rollers 100 and 102 are rotatably mounted to the supporting leg 96, as in FIG. 1, by means of pins 104 and 105, respectively. A resizing wheel 118 is rotatably mounted to the adjusting leg 106 by means of pin 126. The resizing wheel 118 has a substantially uniform outer peripheral cross-section which is positioned substantially between the two opposing rollers 100 and 102, and the resizing wheel 118 has a length less than the length of each of two rollers 100 and 102.

The adjusting leg 106 is adjusted relative to the supporting leg 96 by means of a screw mechanism 112 which is rotated by means of handle 114. In this particular embodiment, the adjusting leg 106 is pulled toward the supporting leg 96 by rotating handle 114.

Referring again to the drawings, there is shown in FIG. 4 a third embodiment of a tube-resizing tool 130 (also referred to as a tubing resizing tool). The tool comprises a frame assembly 132 including a supporting leg 136 and an adjusting leg 164, the supporting leg 136 and the adjusting leg 164 are positioned in such a way as to straddle and secure the section of tubing 180 to be resized, and the adjusting leg 164 is adjustable toward or away from the supporting leg 136 and securable so as to accommodate and secure tubing of different diameters.

Two rollers 166 and 168 are rotatably mounted to the adjusting leg 164 by means of pins 172 and 173, respectively. A resizing wheel 140 is rotatably mounted to the supporting leg 136 by means of pin 146. The resizing wheel 140 has a substantially uniform outer peripheral cross-section which is positioned substantially between the two opposing rollers 166 and 168, and the resizing wheel 140 has a length less than the length of each of two rollers 166 and 168.

The adjusting leg 164 is adjusted relative to the supporting leg 136 by means of a screw mechanism 142 which is rotated by means of handle 156. In this particular embodiment, the adjusting leg 164 is pushed toward the supporting leg 136 by rotating handle 156.

The embodiment of FIG. 4 is similar to FIG. 2 except that the tandem rollers 166 and 168 are rotatably mounted to the adjusting leg 164 while the resizing wheel 140 is rotatably mounted to the supporting leg 136. Of course, the embodiment of FIG. 3 could also be modified with the resizing wheel mounted to the supporting leg and the tandem rollers mounted to the adjusting leg.

The incremental tube-resizing tool 10 has been shown and described in what is considered to be one of the three most practical and most preferred embodiments. However, it should be recognized that changes may be made by those skilled in the art without departing from the spirit and scope of the invention.

I claim:

1. A tube-resizing tool comprising:

(a) a frame assembly including a first leg and a second leg, the first leg being adjustable toward or away from the second leg which is fixed to the frame assembly;

(b) two rollers of substantially identical common length and substantially uniform outer peripheral cross-section rotatably mounted in tandem to the second leg; and (c) a resizing wheel rotatably mounted to the first leg, the resizing wheel having a substantially uniform outer peripheral cross-section and a length less than the length of each of the rollers, wherein the axes of the rollers and the axis of the resizing wheel are substantially parallel and the midpoint of the length of the resizing wheel and the midpoints of the length of the rollers lie in a plane substantially perpendicular to their axes.

2. The tube-resizing tool as recited in claim 1, wherein the axis of the resizing wheel is positioned substantially between the axes of the two rollers.

3. The tube-resizing tool as recited in claim 1, wherein the ratio of the length of the rollers to the length of the resizing wheel is about 2 to 1.

4. A tube-resizing tool comprising:

(a) a frame assembly including a first leg and a second leg, the first leg being adjustable toward or away from the second leg which is fixed to the frame assembly;

(b) two rollers of substantially identical common length and substantially uniform outer peripheral cross-section rotatably mounted in tandem to the first leg; and (c) a resizing wheel rotatably mounted to the second leg, the resizing wheel having a substantially uniform outer peripheral cross-section and a length less than the length of each of the rollers, wherein the axes of the rollers and the resizing wheel are substantially parallel and the midpoint of the length of the resizing wheel and the midpoints of the lengths of the rollers lie in a plane substantially perpendicular to their axes.

5. The tube-resizing tool as recited in claim 1, wherein the axis of the resizing wheel is positioned substantially between the axes of the two rollers.

6. The tube-resizing tool as recited in claim 4, wherein the ratio of the length of the rollers to the length of the resizing wheel is about 2 to 1.

* * * * *